United States Patent [19]

Warnke et al.

[11] Patent Number: 4,707,385

[45] Date of Patent: Nov. 17, 1987

[54] METHOD FOR DIRECTLY ENAMELING STEEL PARTS USING A SINGLE ENAMEL COATING

[75] Inventors: Heinrich Warnke, Marienfeld; Friedel Kaup, Gutersloh; Bernhard Bersch, Dortmund; Willi Mertinkat, Dortmund; Ulrich Tenhaven, Dortmund, all of Fed. Rep. of Germany

[73] Assignees: Miele & Cie. GmbH & Co.; Hoesch Aktiengesellschaft, both of Fed. Rep. of Germany

[21] Appl. No.: 869,852

[22] Filed: May 27, 1986

Related U.S. Application Data

[63] Continuation of Ser. No. 689,390, Jan. 7, 1985, abandoned.

[30] Foreign Application Priority Data

Nov. 1, 1984 [DE] Fed. Rep. of Germany ..... 3400619

[51] Int. Cl.[4] ..... B05D 3/02

[52] U.S. Cl. ..... 427/374.1; 427/318; 427/376.5; 427/380

[58] Field of Search ..... 427/376.4, 376.5, 379, 427/380, 374.7, 374.1, 374.4

[56] References Cited

U.S. PATENT DOCUMENTS

| | | | |
|---|---|---|---|
| 2,455,331 | 11/1948 | Eckel et al. | 427/318 |
| 2,572,702 | 10/1951 | Davis | 427/376.5 |
| 2,677,625 | 5/1954 | Eckel et al. | 427/318 |
| 2,754,222 | 7/1956 | Healy et al. | 427/376.5 |
| 2,842,458 | 7/1958 | Feeney et al. | 427/376.5 |
| 2,886,463 | 5/1959 | Liest | 427/374.7 |
| 2,961,337 | 11/1960 | Bryant et al. | 427/376.5 |
| 3,911,177 | 10/1975 | Humbert et al. | 427/376.5 |

FOREIGN PATENT DOCUMENTS

| | | | |
|---|---|---|---|
| 2257280 | 6/1973 | Fed. Rep. of Germany | 427/318 |
| 624967 | 6/1949 | United Kingdom | 427/318 |
| 626008 | 7/1949 | United Kingdom | 427/318 |

OTHER PUBLICATIONS

Deringer, "Relation of Hydrogen to Adherence of Sheet Enamels", J. of the American Ceramic Society, vol. 26, No. 5, pp. 151–159, May 1, 1943.

*Primary Examiner*—Sadie L. Childs

[57] ABSTRACT

The invention concerns a method for firing enamel on steel parts, especially on steel sheet of aluminum stabilized continuous cast steel material, as well as an enameling oven with a firing zone and an entry zone serving as a prewarming zone for the carrying out of this process. The invention is characterized in that the heating of the steel part or steel sheet to the firing temperature is interrupted before reaching the firing temperature, in that hydrogen dissolved in the steel is released during the interruption time, that the steel part subsequently is heated further to the firing temperature, is held at this temperature and is then cooled in a known way. The enameling oven for carrying out the method consists according to the invention of a degasing zone inserted between the firing zone and the prewarming zone, in which degasing zone the workpiece coated with enamel is held for a given minimum time at a definite temperature.

6 Claims, 6 Drawing Figures

FIG. 1
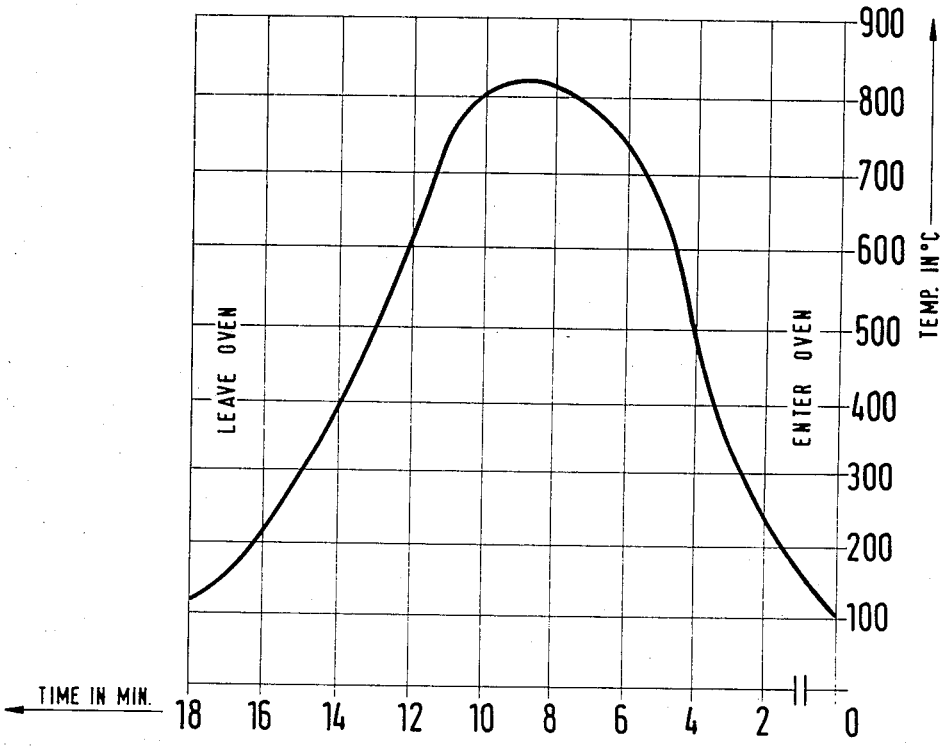
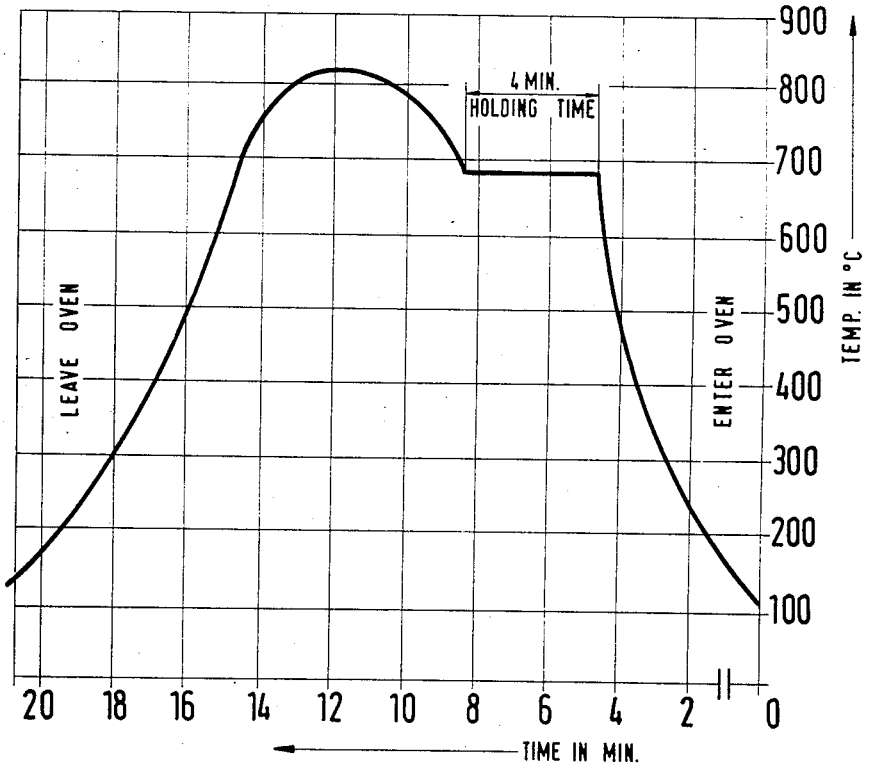
FIG. 2

FIG.3 WELTED THIN SHEETS WITH BLOW OUTS AT THE WELD SEAMS

FIG. 4 WELDED THIN SHEETS WITHOUT BLOW-OUTS AT THE WELD SEAMS

METHOD FOR DIRECTLY ENAMELING STEEL PARTS USING A SINGLE ENAMEL COATING

This is a continuation of co-pending application Ser. No. 689,390 filed on Jan. 7, 1985 now abandoned.

The invention concerns a method for firing enamel on steel parts, especially on steel sheet of aluminum stablized continuously cast steel material and an enameling oven with a firing zone and an inlet zone serving as a prewarming zone for the firing of enamel, especially on steel parts, for carrying out the process.

Methods for enameling steel parts and steel sheet are known in different forms and enameling ovens are also known. A disadvantage both with direct white enameling as well as with base and superimposed layer enameling is the formation of so called blow-outs which most usually are observed at welding seams, cut edges, and radii of the parts to be enameled. Such blow-outs especially appear at welded seams in the direct enameling of aluminum stablized sheet, for example continuously cast thin sheet subsequently decarbonized in open coil. After the firing of the enamel open pockets appear in the enamel layer at the welded seam which commonly are referred to as blow-outs.

Another typical fault recognized on enameled steel surfaces is generally referred to as fish scales. Such fish scales are caused by the release of hydrogen from the material of the workpieces. An especially unpleasant characteristic of this release of hydrogen is that it often first appears weeks after the firing of the enamel so that the fault containing parts are already assembled with other parts or are already packaged. Thus the faults may be first detected by customers. To avoid the mentioned faults on enameled steel parts or sheets very often only steel parts of special quality are used or the workpieces are enameled on only one side so that released substances, for example hydrogen, can escape from the non-enameled surface. In case of dip enameled workpieces these possibilities do not exist and moreover for corrosion protection an enameling of all sides of the workpieces is very often required. In these cases therefore only expensive special steel was previously used. Blow-outs and fish scales are examples of typical enamel faults which are grouped under the heading "hydrogen faults". Hydrogen unavoidablly arises during the firing process from the enamel frit and is absorbed by the steel. During the cooling process the hydrogen partially escapes. Some remains however, depending on the cooling conditions, the thickness of the sheet etc. as well as on the room temperature supersaturated condition of hydrogen in steel.

For avoiding enamel failures caused by hydrogen Dietzel[1]recommends bringing as little possible water vapor into contact with the red hot steel plate and to allow the hydrogen still in the steel to diffuse out of it during a long cooling period, or to hold it as $H_2$ in the smallest of hollow spaces. The named measures do not however give the slightest hint as to the described features of the invention.

[1] Dietzel, A.H.: *Enameling*, Springer-Verlag, Berlin, Heidelberg, New York 1981.

The invention has as an object the provision of a method of the foregoing type by means of which the mentioned faults at welding seams, cut edges and radii of enameled parts are avoided, especially in the case of direct white enameling of aluminum stablized thin sheet made of continuously cast steel. The invention has as a further object the provision of an enameling oven for firing enamel in the carrying out of the process of the invention.

These objects are solved in accordance with the invention in that the heating of the steel part or steel sheet to the firing temperature, before reaching the firing temperature the heating is interrupted, in that the hydrogen dissolved in the steel is released during the time of the interruption, in that the steel part subsequently is heated further to the firing temperature, is held at this temperature and then is cooled in a known way. The enameling oven of the invention is so built that between the firing zone and the prewarming zone a degasing zone is interposed in which the workpieces coated with enamel are held for a certain minimum time at a certain temperature. Further advantageous refinements of the inventive method as well as the enameling oven are apparent from the following description as well as from the dependent claims.

The advantage of the method of the invention as well as of the enameling oven is especially to be seen in that certain types of faults, produced by a gas from the steel used, especially the hydrogen content of the steel parts or sheet to be enameled, are avoided. Moreover additional costly special measures in the manufacture of the steel are avoided in relatively simple manner.

The invention is explained hereafter in comparison to the state of the art in connection with preferred embodiments explained in detail.

The drawings are:

FIG. 1 is a conventional heating and cooling curve.

FIG. 2 is a heating curve according to the invention.

DESCRIPTION OF THE PREFERRED EMBODIMENT

According to the state of the art a piece coated with enamel frit is heated in an open tunnel oven in about eight minutes to 810° C. to 840° C. and is then held at this temperature for about two minutes to secure a good adhesion of the enamel layer to the upper surface of the sheet.

Figure 3:
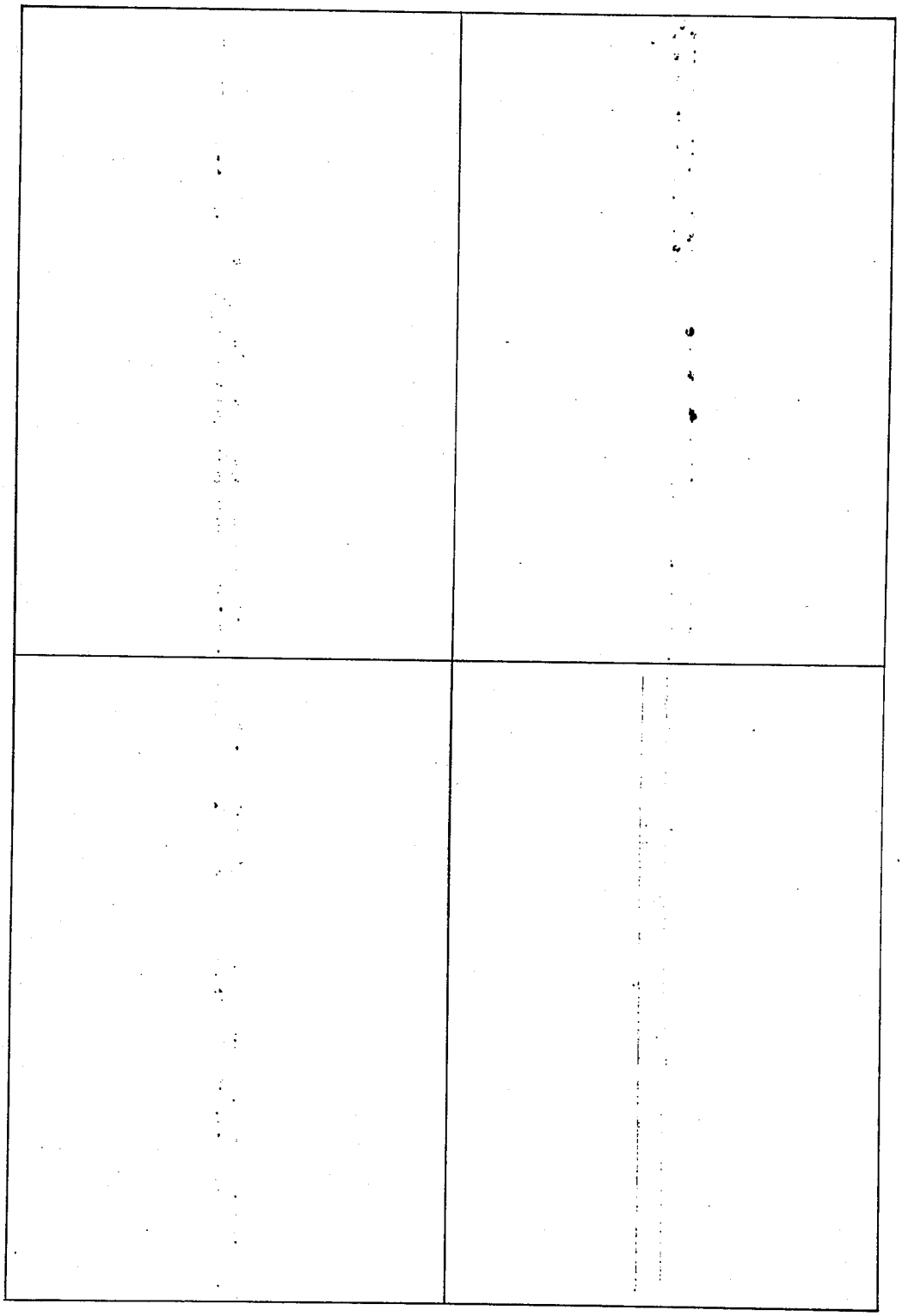
FIG. 3 is a photograph of an enameled steel sheet containing faults.

Subsequently the part is cooled in a non-heated oven zone in eight minutes to about 100° C. and thereupon leaves the oven. The further cooling to room temperature takes place outside of the firing oven. A corresponding heating and cooling curve is shown in FIG. 1. During operation of the oven, in accordance with the described temperature curve, blow-outs appear at the welded seams of aluminum stabilized sheets, such as for example those made of continuous cast material. Usually the cause of enamel faults, such as for example blow-outs, is regarded to be hydrogen explosively escaping from the steel. Photographs of four steel test sheets are shown in FIG. 3.

In contrast to this, in accordance with the invention the piece to be enameled is heated to about 680° C., is then held at this temperature for between three and five minutes, and subsequently is brought in the usual way to the firing temperature, of 810° C. to 840° C. of the enamel; after which it is cooled in the usual way in about eight minutes to 100° C. A corresponding heating and cooling curve is shown by FIG. 2. Faults of the mentioned type, namely so called blow-outs, are not obtained with this treatment of the enameled parts or sheets, as evidenced by the photographs of FIG. 4.

The same effect is obtained if the part to be enameled is heated to 700° C. or 720° C. and is held for three to four minutes at this temperature before the part is further heated to the firing temperature.

In particular, parts to be enameled having seam welds made under a protective gas are prepared as follows in a known way:

(1) Grease removal in 3% akaline solution at 80° C. for five minutes.

(2) Hot rinsing in water at 80° C. for five minutes.

(3) Grease removal in 2% akaline solution at 80° C. to 90° C. for five minutes.

(4) Hot rinsing at 60° C. for five minutes.

(5) Cold rinsing at 20° C. for five minutes.

(6) Pickling in 9% sulphuric acid at 70° C. for eight minutes.

(7) Cold rinsing at 20° C. for five minutes.

(8) Nickling in a nickle sulfate bath (12g $NiSO_4$ $7H_2O$/1 water, pH=3.0–3.2) at 70° C. for about eight minutes.

(9) Cold rinsing at 20° C. for five minutes.

(10) Cold rinsing at 20° C. for five minutes.

(11) Drying at 110° C.

(12) Application of the enamel slurry.

(13) Drying of the slurry at 110° C.

Figure 4:
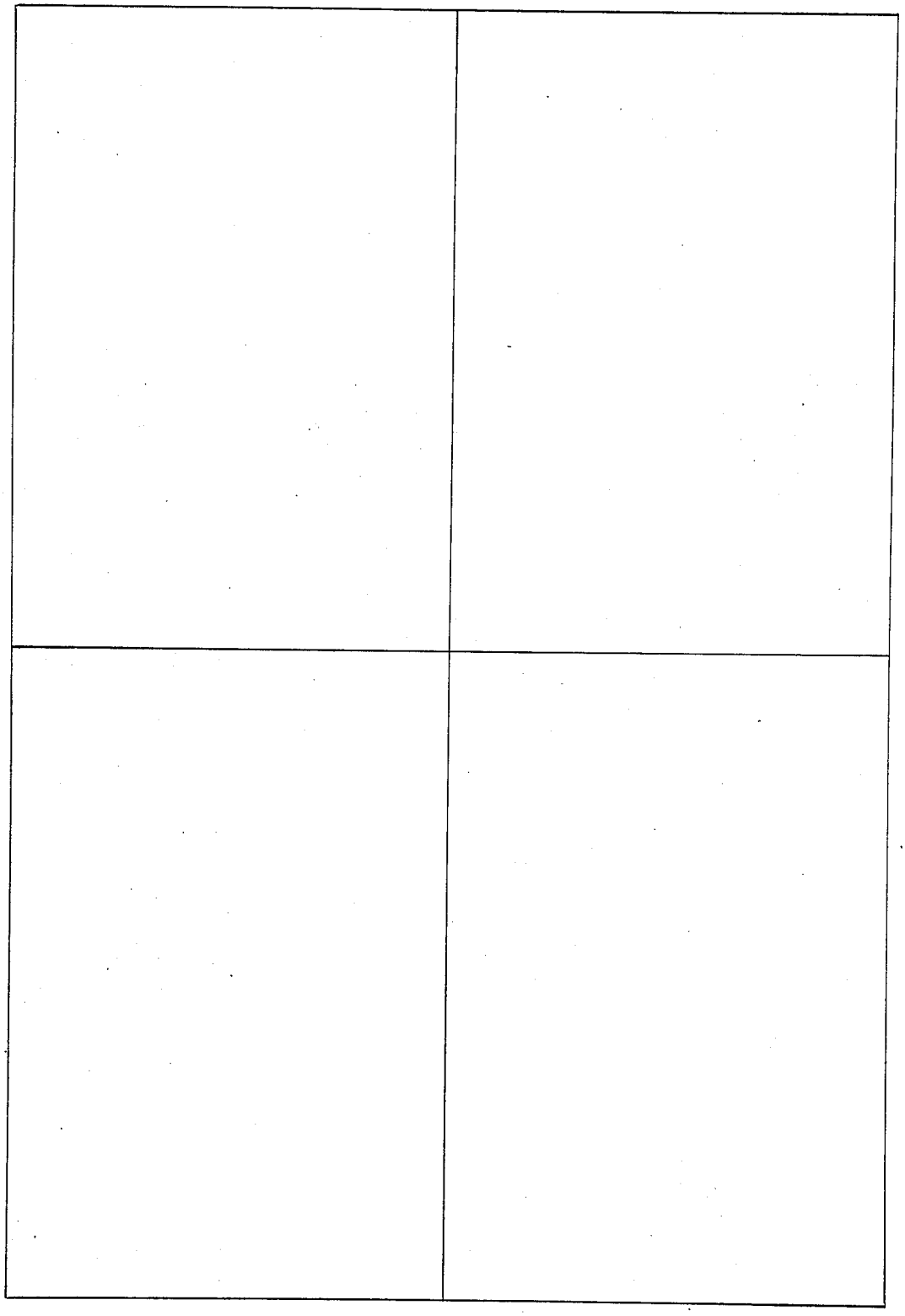
FIG. 4 is a photograph of an enameled steeled sheet free of faults.

Subsequently the parts are enameled in a firing oven made in accordance with the invention according to the temperature curve of FIG. 2. The enameled parts show no blow-outs, instead have a faultless enameled upper surface even at the weld seam (FIG. 4).

Figure 5:
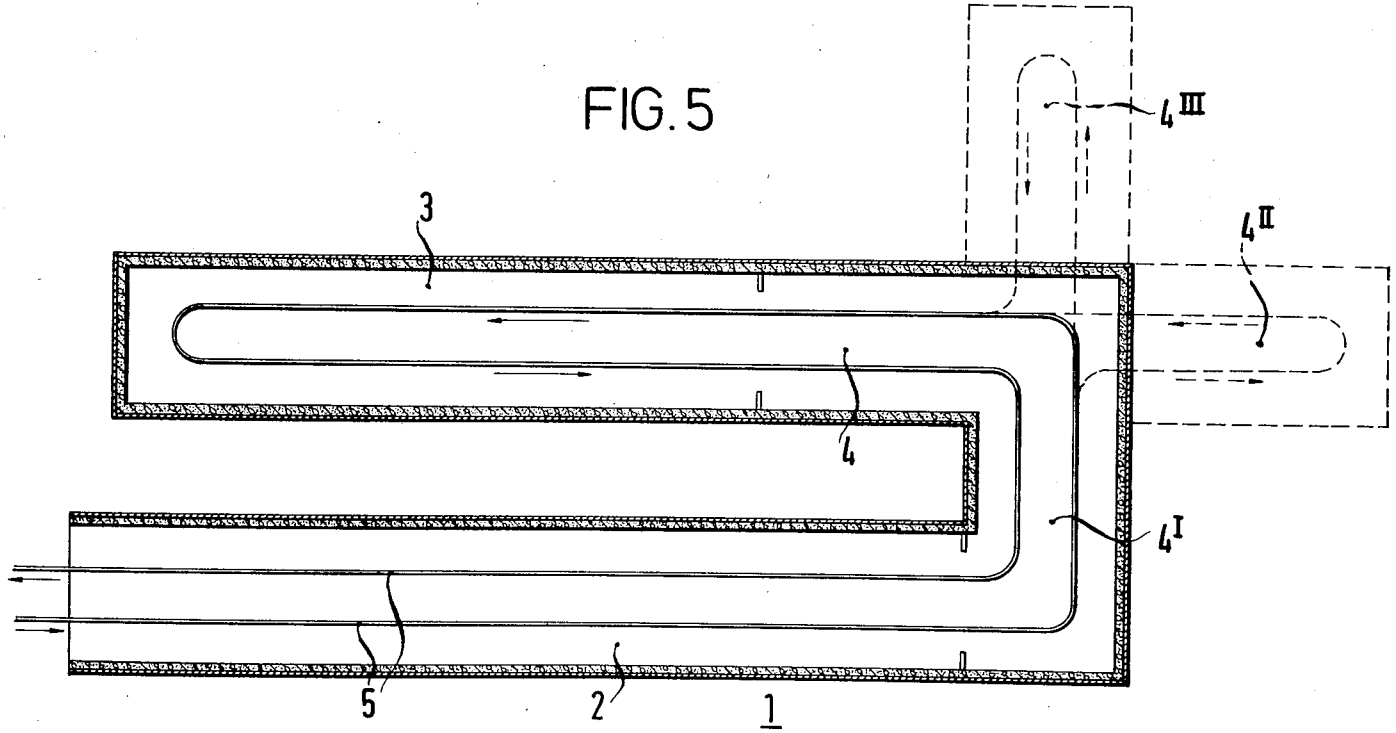
FIG. 5 is a plan view of an enameling oven.

The enameling oven 1 of the invention, as seen in FIG. 5, has a prewarming zone 2 and a firing zone 3. Between the prewarming zone 1 and the firing zone 3 is a degasing zone 4. In this degasing zone the enamel coated workpieces are held for a certain minimum time, as previously explained at a definite temperature. The temperature and the minimum holding time of the enamel coated workpieces in the degasing zone 4 is dependent on the material of the workpieces and on the substance to be removed by the degasing.

Figure 6:
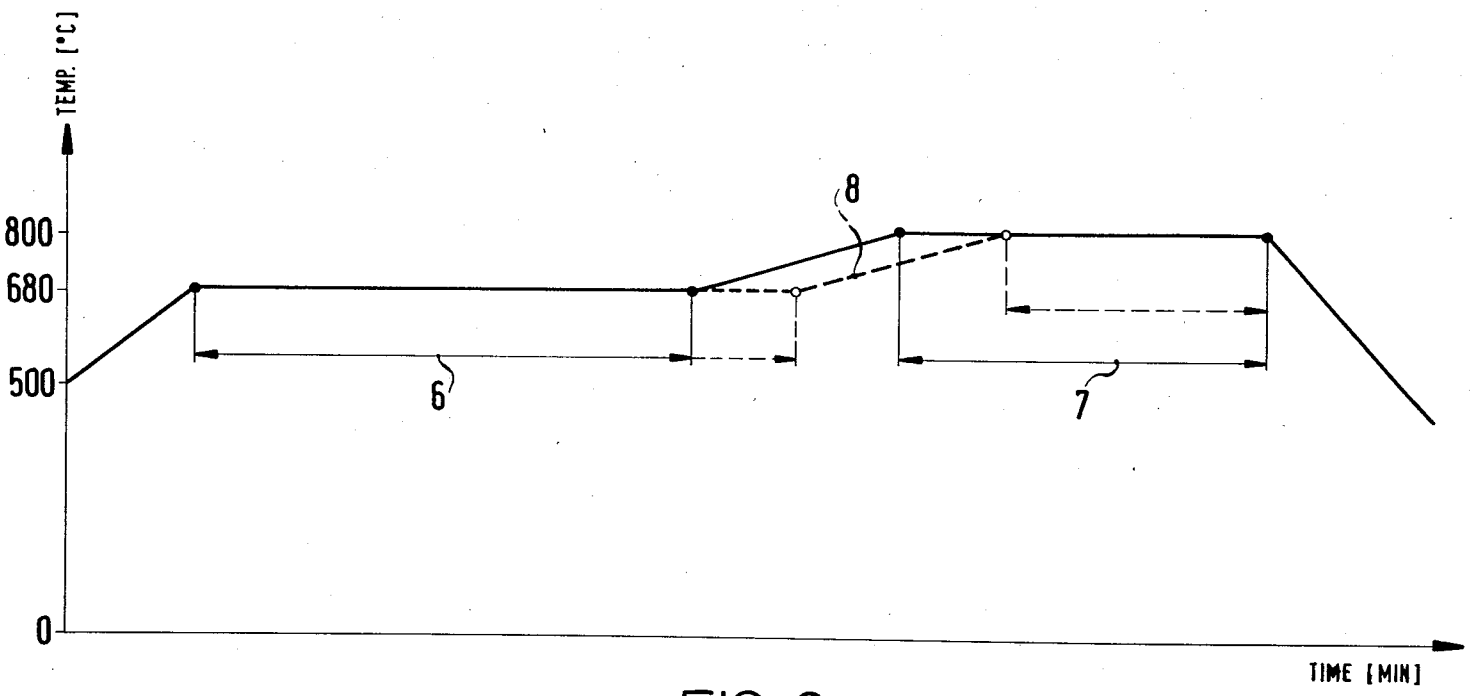
FIG. 6 is a further schematic heating and cooling curve.

FIG. 6 shows in general form the temperature-time curve for a steel workpiece. In the degasing zone 4 of the oven hydrogen dissolved in the steel is allowed to diffuse out of it, that is, hydrogen is removed from the steel of the workpiece before the firing of the enamel coat.

The workpiece is moved through the prewarming zone 2 by a transport device 5 which for example may consist of a transport chain. Since at the same time as this heated workpieces are moved out of the firing zone 3 by the adjacent transport chain the entering workpieces are prewarmed by heat exchange from the leaving workpieces in opposite flow. Thereafter the workpieces are moved by the transport device 5 through the degasing zone 4. In the degasing zone 4 the workpieces are heated to a minimum of 680° C. to a maximum of 760° C. This degasing temperature is held at least for three minutes. In the temperature area of 680° C. to 760° C. the hydrogen escapes from the workpiece in gasous form so that after a given minimum time this gas releasing process is completed. In the degasing zone the gasous hydrogen can escape from the upper surface which is already coated with enamel since the enamel coat is not yet fired and therefore does not yet form a closed surface over the upper surface of the workpiece. Thereafter the workpiece can be moved without cooling into the firing zone 3 by the transport device 5 and then heated to the desired enamel firing temperature.

In the embodiment of the invention shown in FIG. 6 this firing temperature is 800° C.

Since the hydrogen has already been removed from the workpiece in the degasing zone 4, no faults due to the emission of gas can subsequently be formed. Moreover by the provision of a separate degasing zone the degasing can be carried at an optimum degasing temperature.

Because of the interposition of the degasing zone 4 the keeping of a minimum time is possible the length of the degasing zone 4 can be so chosen that the workpieces are held for the necessary minimum time for the degasing at the temperature required for the degasing Should different substances—that is substances with different degasing temperatures—be removed it is possible to insert several degasing zones 4 between the firing zone 3 and the prewarming zone 2.

In FIG. 5 different arrangement possibilities for degasing zones 4, 4', 4'' or 4''' are illustrated.

The degasing zone 4 can either run along the normal chain path of the transport device 5 or can deviate therefrom in different variations (degasing zones 4' 4'' or 4'''). Because of the arrangment of the degasing zones 4' 4'' or 4''' which depart from the normal path of the chain pyrometric advantages can be obtained.

The temperature-holding time 6 in the degasing zone 4 can possibly be slightly lengthened. Since the firing duration in the firing zone 3 can at the same time be shortened the result collectively is no lengthening of the total firing time. This shift 8 in the path of the curve is illustrated in the temperature time curve of FIG. 6.

Because of the shortening of the firing duration 7 occasioned by the shift 8 the firing zone 3 of the enameling oven 1 can be shortened. Since the highest radiation loss from the enameling oven 1 appears at the high firing temperature in the firing zone 3, by this shortening of the firing zone 3 additional energy can be saved.

We claimed:

1. A method for the direct white enameling of steel parts using a single enamel coating particularly suited for the direct white enameling of steel parts of the type comprising steel sheets of aluminum stabilized continuously cast sheet material, said method comprising the steps of:

applying a single coating of an enamel slurry to the surface of the steel part to be enameled;

drying the slurry on the slurry coated steel part;

degasifying substantially simultaneously the slurry and the steel part coated with the slurry by heating the slurry coated steel part to a degasifying temperature which degasification temperature is at a temperature less than the firing temperature of the enamel coating wherein the slurry coated steel part is held within the degasifying temperature range for a time period sufficient to diffuse hydrogen gas from the steel part and the slurry coating, said diffused hydrogen gas passing from the steel part through the unfired enamel slurry coating to the atmosphere;

firing the degasified enamel slurry coating on the degasified steel part by increasing the temperature of the degasified enamel slurry coated steel part to the enamel firing temperature directly from the degasifying temperature without cooling the degasified slurry coated steel part between the degasifying step and the firing step;

maintaining the temperature of the slurry coated steel part at the enamel firing temperature for a time period sufficient to fire the single enamel coating, and cooling the fired enamel coated steel part wherein the temperature of the fired enamel coated steel part is lowered from the enamel firing temperature to a lower cooling temperature during a predetermined cooling time interval.

2. A method for the direct white enameling of steel parts using a single enamel coating as defined in claim 1 wherein the degasifying step includes maintaining the heated slurry coated steel part within the degasifying temperature range of 680° C. to 760° C. for two (2) to six (6) minutes.

3. A method for the direct white enameling of steel parts using a single enamel coating as defined in claim 1 wherein the degasifying step includes maintaining the heated slurry coated steel part at the degasification temperature of 720° C. for three(3) to five(5) minutes.

4. A method for the direct white enameling of steel parts using a single enamel coating as defined in claim 2 wherein the enamel firing step includes firing the enamel coated steel part at a firing temperature of 800° C.

5. A method for the direct white enameling of steel parts using a single enamel coating as defined in claim 2 wherein the enamel firing step includes firing the enamel coated steel part at a temperature within the range of 810° C. to 840° C.

6. A method for the direct white enameling of steel parts using a single enamel coating particularly suited for the direct white enameling of steel parts of the type comprising steel sheets of aluminum stabilized continuously cast sheet material, said method comprising the steps of:

applying a single coating of an enamel slurry to the surface of the steel part to be enameled;

drying the slurry on the slurry coated steel part;

degasifying substantially simultaneously the slurry and the steel part coated with the slurry by heating the slurry coated steel part to a degasifying temperature which degasification temperature is at a temperature less than the firing temperature of the enamel coating wherein the slurry coated steel part is held within the degasifying temperature range of 680° C. to 760° C. for two(2) to six(6) minutes to diffuse hydrogen gas from the steel part and the slurry coating, said diffused hydrogen gas passing from the steel part through the unfired enamel slurry coating to the atmosphere;

preventing the heated enamel slurry coated steel part from being cooled after the degasifying step and prior to an enamel firing step;

firing the degasified enamel slurry coating on the degasified steel part by increasing the temperature of the degasified enamel slurry coated steel part to the enamel firing temperature;

maintaining the temperature of the slurry coated steel part at the enamel firing temperature of 800° C. for a time period sufficient to fire the single enamel coating, and cooling the fired enamel coated steel part wherein the temperature of the fired enamel coated steel part is lowered from the enamel firing temperature to a lower cooling temperature during a predetermined cooling time interval.

* * * * *